US009937098B1

(12) United States Patent
Elmore

(10) Patent No.: US 9,937,098 B1
(45) Date of Patent: Apr. 10, 2018

(54) SPA JET REPLACEMENT SYSTEM AND METHOD FOR ITS USE

(71) Applicant: James W Elmore, Youngstown, FL (US)

(72) Inventor: James W Elmore, Youngstown, FL (US)

( * ) Notice: Subject to any disclaimer, the term of this patent is extended or adjusted under 35 U.S.C. 154(b) by 0 days.

(21) Appl. No.: 15/450,081

(22) Filed: Mar. 6, 2017

(51) Int. Cl.
*A61H 33/04* (2006.01)
*A61H 33/00* (2006.01)
*E04H 4/16* (2006.01)

(52) U.S. Cl.
CPC ..... *A61H 33/60* (2013.01); *A61H 33/0087* (2013.01); *E04H 4/169* (2013.01)

(58) Field of Classification Search
CPC ..... A61H 33/60; A61H 33/0087; A61H 33/6021; A61H 33/027; E04H 4/169
USPC ..... 4/541.6, 492, 541.5; 239/428.5
See application file for complete search history.

(56) References Cited

U.S. PATENT DOCUMENTS 1,982,261 A * 11/1934 Martin ..... A61H 33/025 4/559
3,067,435 A * 12/1962 Nash ..... A61H 33/027 261/77
4,671,463 A * 6/1987 Moreland ..... A61H 33/027 239/428.5
5,014,372 A * 5/1991 Thrasher ..... B05B 3/003 239/414
5,987,663 A 11/1999 Ludlow et al.
5,992,466 A * 11/1999 Weise ..... A61H 33/027 138/120
6,256,805 B1 7/2001 Ludlow et al.
6,904,626 B1 * 6/2005 Hester ..... A61H 33/027 239/428.5
7,908,684 B2 3/2011 Ludlow
8,176,578 B2 5/2012 Hatrick-Smith et al.
8,661,576 B2 3/2014 Ludlow et al.
2005/0050627 A1 * 3/2005 Ayeni ..... A61H 33/6063 4/541.6

* cited by examiner

*Primary Examiner* — Benjamin R Shaw
(74) *Attorney, Agent, or Firm* — Peter Loffler

(57) ABSTRACT

A spa jet replacement system uses a hollow tubular positioning sleeve having an opening located proximate a first end thereof. A spa jet is inserted into the first end of the sleeve and the sleeve is inserted into the nozzle system of a spa until the opening of the sleeve aligns with an air inlet of the nozzle system, thereby positioning the spa jet upstream of the air flow of the spa fluid system. The outside diameter of the sleeve approximates the pipe(s) of the nozzle into which the sleeve is inserted so that the sleeve is friction held in place after insertion. A longitudinal slit may be located on the sleeve for ease of insertion.

12 Claims, 4 Drawing Sheets

SPA JET REPLACEMENT SYSTEM AND METHOD FOR ITS USE

BACKGROUND OF THE INVENTION

1. Field of the Invention

The present invention relates to a system whereby a broken jet of a spa can be quickly and easily repaired without the need for a deck tear out.

2. Background of the Prior Art

Pool ownership is at records levels in the United States, especially in the warm southern states. There is no better way to beat the summer heat than a cool dip in the pool which is often the center of a home's attention during the warm summer months. In addition to installation of the pool, many home owners are opting to include a spa with the installation of the main pool. The spa, used for hydrotherapy, provides a hot body of water with high speed jet blasts of water to massage and soothe sore and tired muscles. As the spa is heated, and at much lower cost than heating of the pool proper if the pool is so designed, it is not unusual for the spa to be used year round in all but the most extreme northern climates.

While a spa is a great addition to a pool installation, just like the main pool, the spa requires regular maintenance. One of the components that tends to fail on a spa is the spa jet. The spa jet is a small restrictor body with one or more small jet openings that constrict the flow of water therethrough and cause the water flow to exit the jet at high pressure. The high pressure water stream mixes with a stream of high pressure air blown in and this mixture exits a nozzle on the side wall (or base) of the spa in order to create the soothing jet stream for the user. If the jet fails, the water path is either blocked so that little to no water exits that particular nozzle, leaving only an air stream to exit, which is not very soothing, or the water free flows does not sufficiently pressurize so that the water and air mixture come out at a much slower speed thereby negating any jet effect and, as the water stream through all of the jets is via a manifold, substantially reduces the water pressure at the remaining jets.

While the spa jet proper is a relatively inexpensive part, costing on the order of a few dollars for many models, access to the repair site is difficult. The spa jet resides deep within the nozzle system of the spa, located between the water inlet of the manifold feeding the nozzle and the air supply inlet, and is not readily accessible externally of the spa. Retrieval of the broken spa jet, if still resident within the nozzle, is not very difficult for the most part. A 1.5 inch hole saw and extension, along with a drill, are used to cut and pull out of the outlet of the nozzle. Placing a new spa jet into place is the difficult task. Typically, the decking around the spa or a portion of the spa structure proper must be torn out, the spa jet replaced, and thereafter the torn out concrete must be repaired. Not only is this procedure costly and time-consuming, requiring several different tradesman to complete, but often leaves the spa owner with an obviously repaired look on his or her spa, especially if the finish colors of the repair area cannot be precisely matched to the existing colors of the spa or the pool to which the spa is attached.

What is needed is a device that allows a spa owner to be able to quickly and easily replace a broken spa jet while addressing the above stated shortcomings noted in the art. Specifically such a device must be able to quickly and easily install a new spa jet in its proper location and position within the spa nozzle system without the need to tear out any decking or other concrete components in and around the spa. Such a device must be easy to use, even by a person who is not particularly skilled in home repairs.

SUMMARY OF THE INVENTION

The spa jet replacement system and method for its use of the present invention addresses the aforementioned needs in the art by providing a device that allows a person to quickly and easily install a replacement spa jet into its proper position within a spa nozzle system without the need to perform any concrete tear out task and without the need to fully or partially disassemble any portion of the spa's plumbing system. The spa jet replacement system is of relatively simple design and construction, being produced using standard manufacturing techniques, so as to be inexpensive to produce so as to be economically attractive to potential consumers for this type of product. The spa jet replacement system is easy to use, capable of being utilized by a person with little handyman skills, and does not require the use of any tools for its proper functioning.

The spa jet replacement system and method for its use of the present invention is comprised of a hollow tubular positioning sleeve that has a first end and a second end and an opening located proximate the first end. The positioning sleeve receives the spa jet within the first end and the first end is inserted into a nozzle exit pipe of the spa nozzle system so that the opening on the positioning sleeve aligns with the air inlet of the spa nozzle system. The positioning sleeve may have a longitudinal slit extending between the first end and the second end for ease of insertion of the sleeve into the nozzle exit pipe (and connector pipe). The positioning system may be made from PVC. The nozzle exit pipe (and connector pipe) has an inside diameter and the positioning sleeve has an outside diameter that is approximately equal to the inside diameter in order to allow the positioning sleeve to remain friction held resident within the nozzle exit pipe (and connector pipe) once installed.

BRIEF DESCRIPTION OF THE DRAWINGS

Similar reference numerals refer to similar parts throughout the several views of the drawings.

DESCRIPTION OF THE PREFERRED EMBODIMENT

Figure 1:
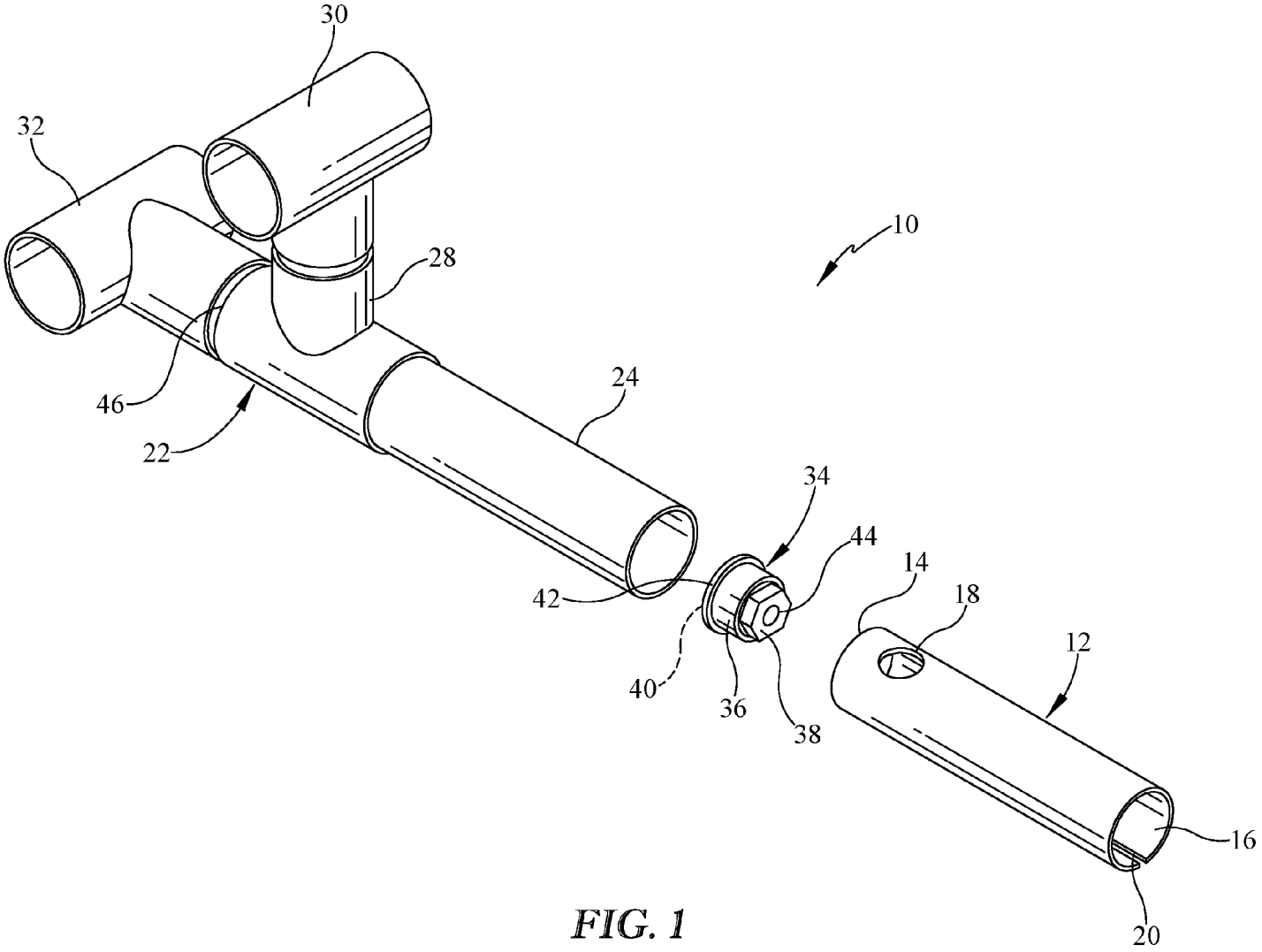
FIG. 1 is a perspective view of the spa jet replacement system and method for its use about to be utilized in a typical nozzle system of a spa.
Figure 2:
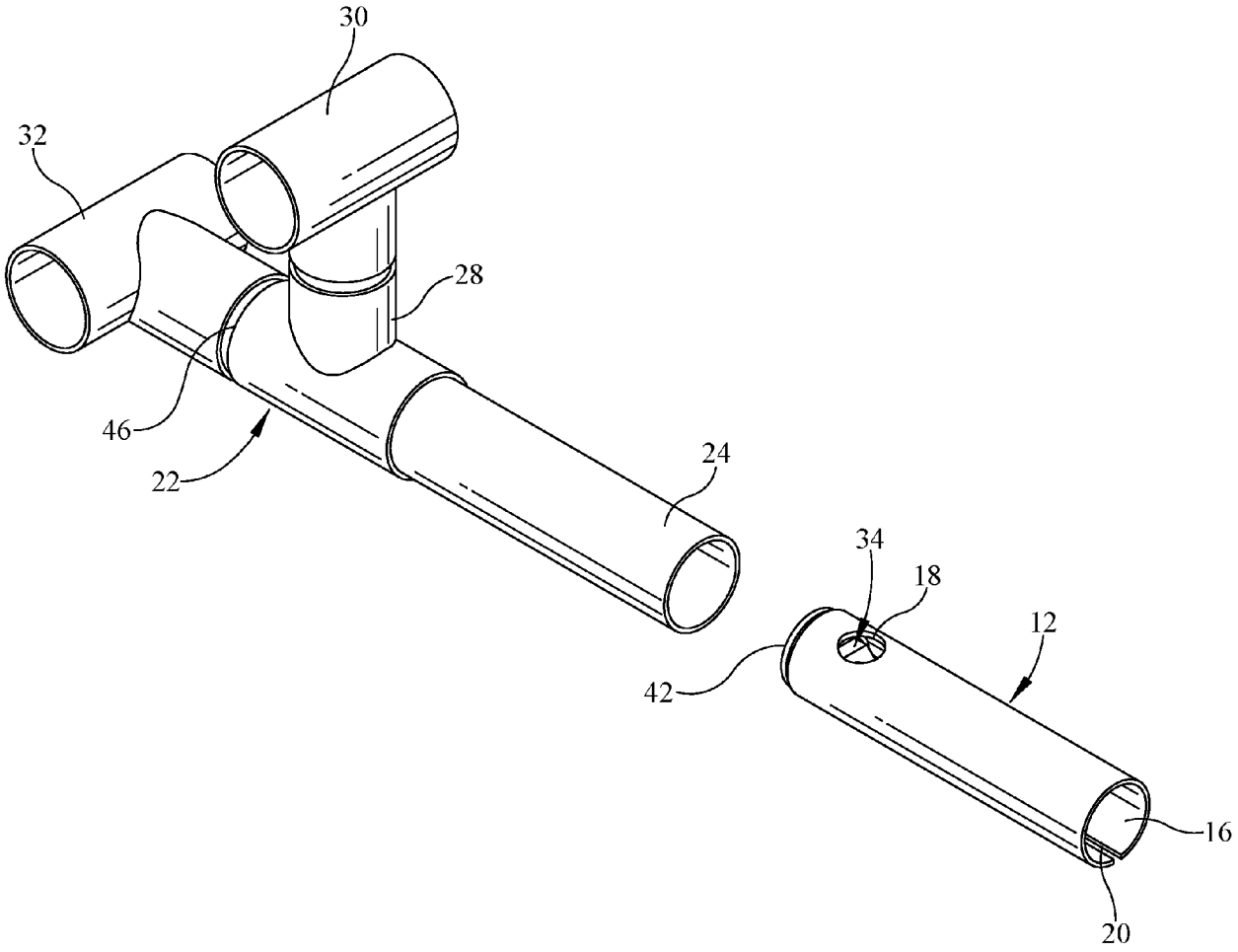
FIG. 2 is a perspective view of the spa jet replacement system and method for its use with the spa jet received within the spa jet replacement system.
Figure 3:
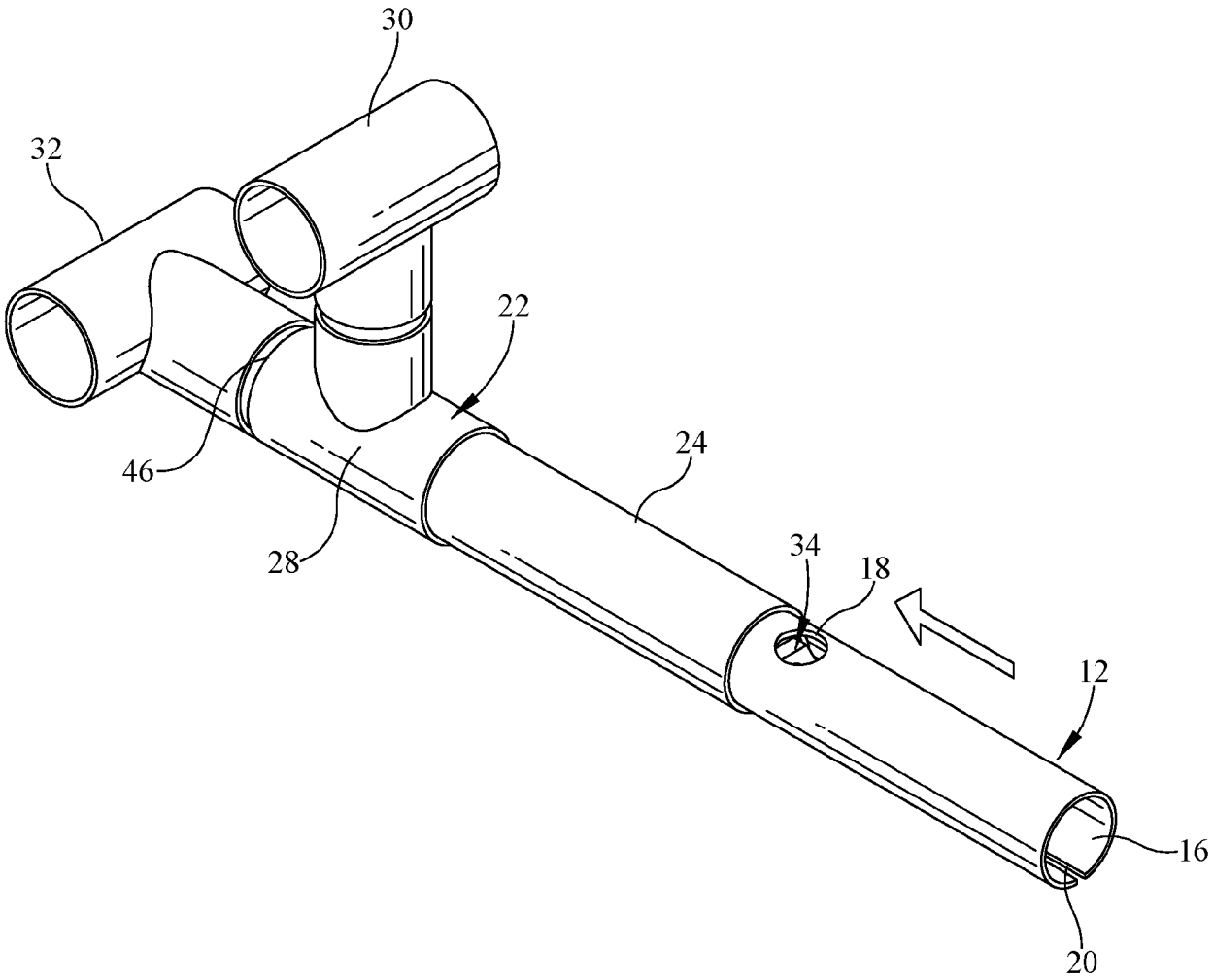
FIG. 3 is a perspective view of the spa jet replacement system and method for its use with the spa jet being initially inserted into the nozzle of the spa nozzle system.
Figure 4:
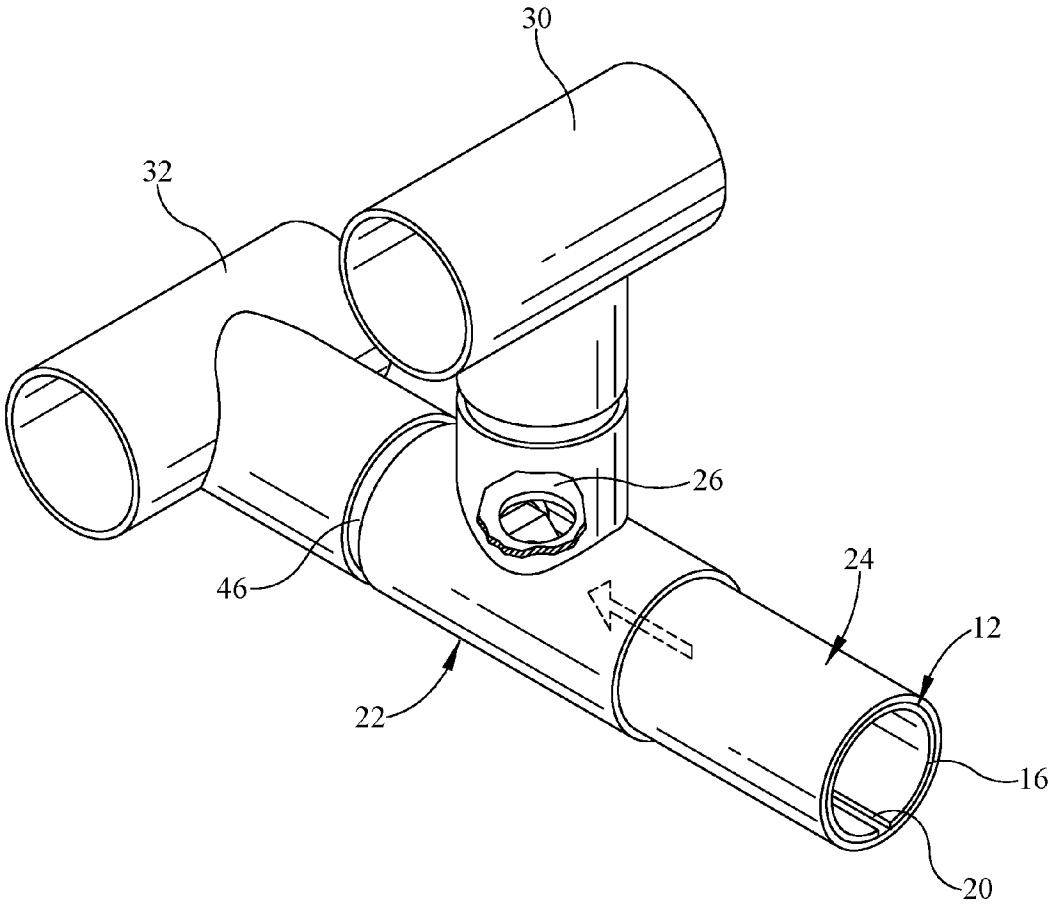
FIG. 4 is a perspective view, partially cut away, of the spa jet replacement system and method for its use in its final position within the nozzle system of the spa.

Referring now to the drawings, it is seen that the spa jet replacement system and method for its use of the present invention, generally denoted by reference numeral 10, is comprised of a positioning sleeve 12 that has a first end 14 and a second end 16. The positioning sleeve 12 is a plumbing pipe and is thus a hollow tubular member that may be made from PVC or similar material. As seen, an opening 18 is located proximate the first end 14 of the positioning sleeve 12. A slit 20 may run longitudinally along the positioning sleeve 12, between the first end 14 and the second end 16 thereof, and radially opposite the opening 18.

As seen in the figures, a typical nozzle system 22 of a spa has a nozzle exit pipe 24 from which the water-air mixture exits into the body of the spa. The nozzle exit pipe 24 is connected to an air inlet 26 via an appropriate T-fitting 28, with the air inlet 26 being air flow connected to a source of blown air, typically via an air manifold system 30. The opposing end of the air inlet T-fitting 28 is connected to a source of pressurized water typically via a water manifold system 32. A spa jet 34 which has a body 36 with a first side 38 and a second side 40, an annular lip 42 located at the second side 40, and an orifice 44 extending between the first side 38 and the second side 40 acts as the fluid flow constrictor. The spa jet 34 is resident within the nozzle system 22 of the spa, located upstream of the air inlet 26, as seen, within the T-fitting of the water manifold system 32. The spa jet 34 is positioned such that annular lip 42 faces toward the source of pressurized water and away from the nozzle exit pipe 24.

The positioning sleeve 12 is dimensioned so that its outside diameter approximates the inside diameter of the nozzle exit pipe 24 as well as the inside diameter of the connector pipe 46 that connects the T-fitting 28 to the water manifold system 32.

In order to use the spa jet replacement system and method for its use 10 of the present invention, the old spa jet is removed from the nozzle system 22 in any appropriate fashion such as via the use of a hole saw and drill as previously described. Thereafter, the spa jet 34 is inserted into the first end 14 of the positioning sleeve 12 via its first side 38. The outer diameter of the annular lip 42 of the spa jet 34 is greater than the inside diameter of the positioning sleeve 12 so that the spa jet 34 cannot be completely inserted into the positioning sleeve 12. Once the spa jet 34 is inserted into the positioning sleeve 12 to its maximum extent, the first side 38 of the spa jet 34 either does not breach or barely aligns with the opening 18 of the positioning sleeve 12. Thereafter, the positioning sleeve 12 is inserted into the nozzle exit pipe 24 of the nozzle system 22 via the positioning sleeve's first end 14 with the opening 18 of the positioning sleeve 12 facing upwardly in the direction of the air inlet 26 of the nozzle system 22. The positioning sleeve 12 is pushed into the nozzle exit pipe 24 and eventually into the connector pipe 46 until the opening 18 of the positioning sleeve 12 aligns with the air inlet 26 of the nozzle system 22. The proper depth of insertion of the positioning sleeve 12 into the nozzle exit pipe 24 is premeasured and the positioning sleeve 12 is cut to its proper length prior to insertion. As the outside diameter of the positioning sleeve 12 approximates the inside diameter of the nozzle exit pipe 24 and connector pipe 46, once the positioning sleeve 12 is inserted in place, it is friction held therein. The positioning sleeve 12 can be helped being inserted into position via an appropriate tool such as a rubber mallet (not illustrated).

If the positioning sleeve 12 has a slit 20, the slit 20 allows the positioning sleeve 12 to deform slightly during the insertion process, making the insertion process easier. As the positioning sleeve 12 is made from PVC or similar material, once the positioning sleeve 12 is in place, the positioning sleeve 12 resiliently springs back to size and helps bias the positioning sleeve 12 in place within the nozzle exit pipe 24 and the connector pipe 42.

The spa jet 34 is now properly in place and the spa is once again ready for use.

While the invention has been particularly shown and described with reference to an embodiment thereof, it will be appreciated by those skilled in the art that various changes in form and detail may be made without departing from the spirit and scope of the invention.

I claim:

1. A spa replacement system for inserting a spa jet into a spa nozzle system between a water manifold and an air inlet within the spa nozzle system, the spa replacement system comprising a hollow tubular positioning sleeve having a first end and a second end and an opening located proximate the first end such that the positioning sleeve is adapted to receive the spa jet within the first end and the first end inserted into a nozzle exit pipe of the spa nozzle system so that the opening is aligned with the air inlet.

2. The spa replacement system as in claim 1 wherein the positioning sleeve has a longitudinal slit extending between the first end and the second end.

3. The spa replacement system as in claim 2 wherein the positioning system is made from PVC.

4. The spa replacement system as in claim 1 wherein the nozzle exit pipe has an inside diameter and the positioning sleeve has an outside diameter that is approximately equal to the inside diameter.

5. The spa replacement system as in claim 1 in combination with the spa jet.

6. The spa replacement system as in claim 5 wherein the positioning sleeve has a longitudinal slit extending between the first end and the second end.

7. The spa replacement system as in claim 6 wherein the positioning system is made from PVC.

8. The spa replacement system as in claim 5 wherein the nozzle exit pipe has an inside diameter and the positioning sleeve has an outside diameter that is approximately equal to the inside diameter.

9. A method for inserting a spa jet into a spa nozzle system between a water manifold and an air inlet within the spa nozzle system, the method comprising the steps of:

providing a hollow tubular positioning sleeve having a first end and a second end and an opening located proximate the first end;

placing the spa jet within the first end; and inserting the first end into a nozzle exit pipe of the spa nozzle system so that the opening is aligned with the air inlet.

10. The method as in claim 9 wherein the positioning sleeve has a longitudinal slit extending between the first end and the second end.

11. The method as in claim 10 wherein the positioning system is made from PVC.

12. The method as in claim 9 wherein the nozzle exit pipe has an inside diameter and the positioning sleeve has an outside diameter that is approximately equal to the inside diameter.

* * * * *